US006748778B1

(12) United States Patent
Higdon et al.

(10) Patent No.: US 6,748,778 B1
(45) Date of Patent: Jun. 15, 2004

(54) BRACED FRONT LOADING LOCK SYSTEM FOR OFFICE FURNITURE

(75) Inventors: Dale B. Higdon, Davenport, IA (US); Charles J. Calcott, Muscatine, IA (US)

(73) Assignee: HON Technology Inc., Muscatine, IA (US)

( * ) Notice: Subject to any disclaimer, the term of this patent is extended or adjusted under 35 U.S.C. 154(b) by 0 days.

(21) Appl. No.: 10/366,920

(22) Filed: Feb. 14, 2003

(51) Int. Cl.[7] ..... E05B 9/08

(52) U.S. Cl. ..... 70/370; 70/371; 70/451; 70/78; 292/DIG. 64

(58) Field of Search ..... 70/78, 370, 371, 70/448, 451, 85, 79–84, 86–88; 312/215; 292/DIG. 53, DIG. 64

(56) References Cited

U.S. PATENT DOCUMENTS 3,740,979 A * 6/1973 Crepinsek ..... 70/139
3,898,822 A * 8/1975 Schalm ..... 70/143
4,453,787 A * 6/1984 Staropoli ..... 312/215
4,457,569 A * 7/1984 Scheerhorn ..... 312/219
4,609,233 A * 9/1986 Walla ..... 312/219
5,435,159 A * 7/1995 Ramsauer ..... 70/370
5,526,553 A 6/1996 Klein ..... 24/295
6,014,876 A * 1/2000 Taylor ..... 70/240
6,079,241 A * 6/2000 Burleigh et al. ..... 70/370
6,094,950 A * 8/2000 Maynard et al. ..... 70/81
6,502,439 B1 * 1/2003 Stirling et al. ..... 70/370
6,691,538 B1 * 2/2004 Yang et al. ..... 70/370

* cited by examiner

*Primary Examiner*—John B. Walsh
(74) *Attorney, Agent, or Firm*—Joseph H. Golant; Jones Day

(57) ABSTRACT

A front loading lock system for office furniture including a lockheader having two openings, a reinforcing channel member attached to the lockheader and also having an opening and a bracing lip, a plastic lock housing which is snap fitted into one of the openings in the lockheader and a lock which is axially inserted into the other of the openings in the lockheader, and into an opening in the lock housing, where the lock is supported by both the lock housing and braced by the bracing lip.

17 Claims, 9 Drawing Sheets

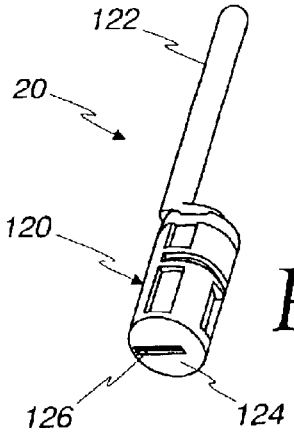
Fig. 23
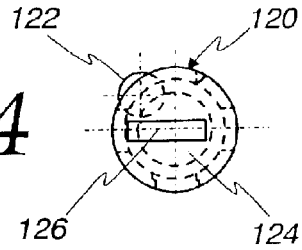
Fig. 24
Fig. 25
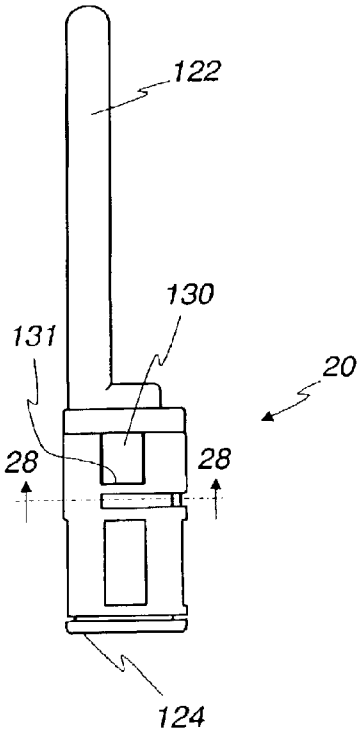
Fig. 26
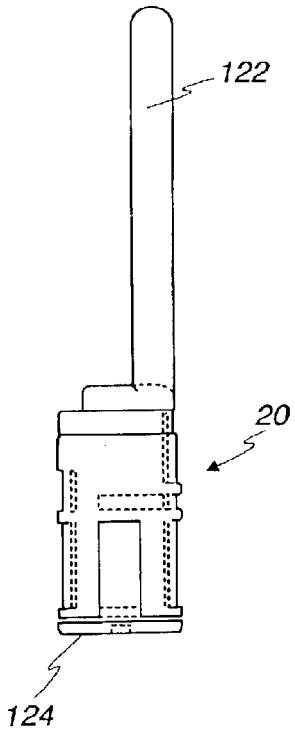
Fig. 27
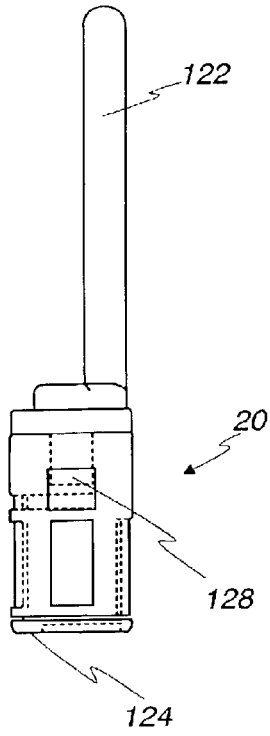
Fig. 28
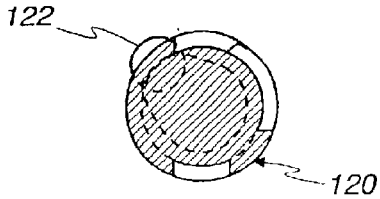

BRACED FRONT LOADING LOCK SYSTEM FOR OFFICE FURNITURE

CROSS REFERENCE TO RELATED APPLICATIONS

Not applicable.

STATEMENT RE FEDERALLY SPONSORED RESEARCH

Not applicable.

BACKGROUND OF THE INVENTION

1. Field of the Invention

The present invention relates to a front loading lock system and more particularly to a strongly braced front loading lock system for office furniture which lock system is structurally simply and easily installed.

2. Description of the Related Art

One way to reduce costs of a product is to simplify its structure and lessen the time needed for assembly. The front loading lock system described here is simply constructed and allows speedy assembly to reduce the cost of production. An important aspect of the disclosed lock system is a lock housing that may be inserted into an opening in a furniture cabinet from outside the cabinet and "snapped" into engagement with the cabinet. Thereafter, a lock including a barrel and a lock bar may also be inserted through a hole in the furniture cabinet and through a hole in the lock housing and then also "snapped" into engagement with the lock housing.

An object of the present invention is to provide a strong, well supported front lock system for office furniture that is simple in structure and is easily and quickly assembled to a piece of office furniture.

BRIEF SUMMARY OF THE INVENTION

What is described here is a strongly braced front loading lock system for office furniture comprising in combination a furniture cabinet, a lockheader forming part of the cabinet, the lockheader having a first opening and a second opening, a reinforcing structure connected to the lockheader, the reinforcing structure having an opening and a support flange, a lock housing connected to the lockheader through the first opening, the lock housing having a body portion with a central opening, a projection and structure for an interference fit with a flange surrounding the first opening of the lockheader, and a lock mounted flush in the second opening of the lockheader and mounted in the central opening of the lock housing, the lock having structure for causing an interference fit between the lock housing and the lock, and the support flange of the reinforcing structure for bracing the lock.

A more complete understanding of the present invention and other objects, advantages and features thereof will be gained from a consideration of the following description of a preferred embodiment read in conjunction with the accompanying drawing provided herein. The preferred embodiment represents an example of the invention which is described here in compliance with Title 35 U.S.C. section 112 (first paragraph), but the invention itself is defined by the attached claims.

BRIEF DESCRIPTION OF THE SEVERAL VIEWS OF THE DRAWING

FIG. 23 is an isometric view of the lock.

FIG. 24 is a front elevation view of the lock.

FIG. 25 is a top plan view of the lock.

FIG. 26 is an elevation view of the lock.

FIG. 27 is a bottom plan view of the lock.

FIG. 28 is a sectional view taken along line 28—28 of FIG. 25.

DETAILED DESCRIPTION OF A PREFERRED EMBODIMENT OF THE INVENTION

Figure 1:
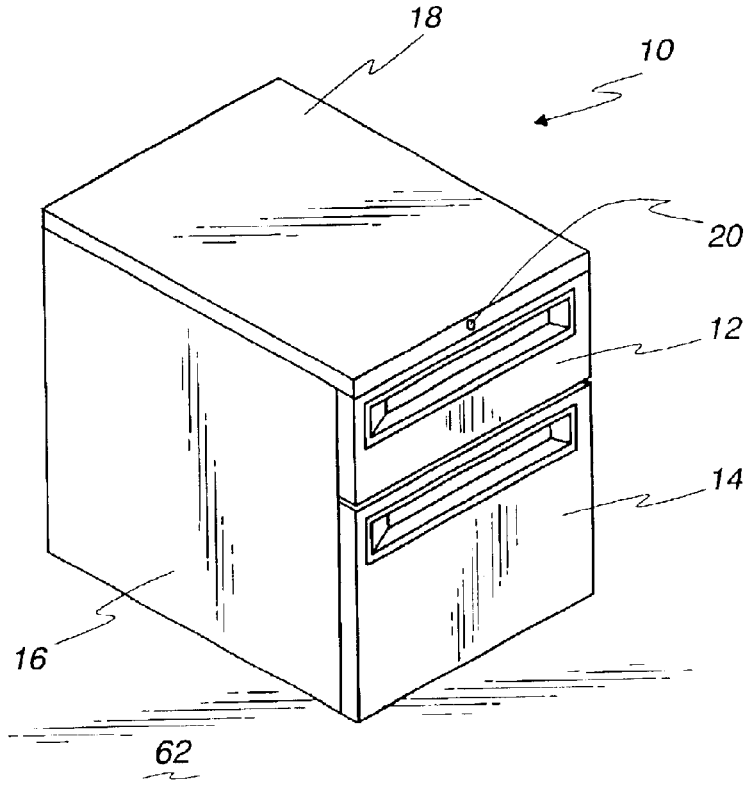
FIG. 1 is an isometric view of a furniture pedestal.

While the present invention is open to various modifications and alternative constructions, the preferred embodiment shown in the various figures of the drawing will be described herein in detail. It is understood, however, that there is no intention to limit the invention to the particular embodiment, structure or example disclosed. On the contrary, the intention is to cover all modifications, equivalent structures and methods, and alternative constructions falling within the spirit and scope of the invention as expressed in the appended claims, pursuant to Title 35 U.S.C. section 112 (second paragraph).

A piece of office furniture 10 is illustrated in FIG. 1 in the form of a two drawer pedestal. The pedestal includes a box drawer 12 and a file drawer 14 and has side walls, such as the side wall 16, a back wall (not shown) and a top wall section 18 also referred to here as a lockheader. Mounted generally flush in the lockheader is a lock 20.

The pedestal illustrated in FIG. 1 is typically used adjacent a work table or a table desk or located under the desk.

Figure 2:
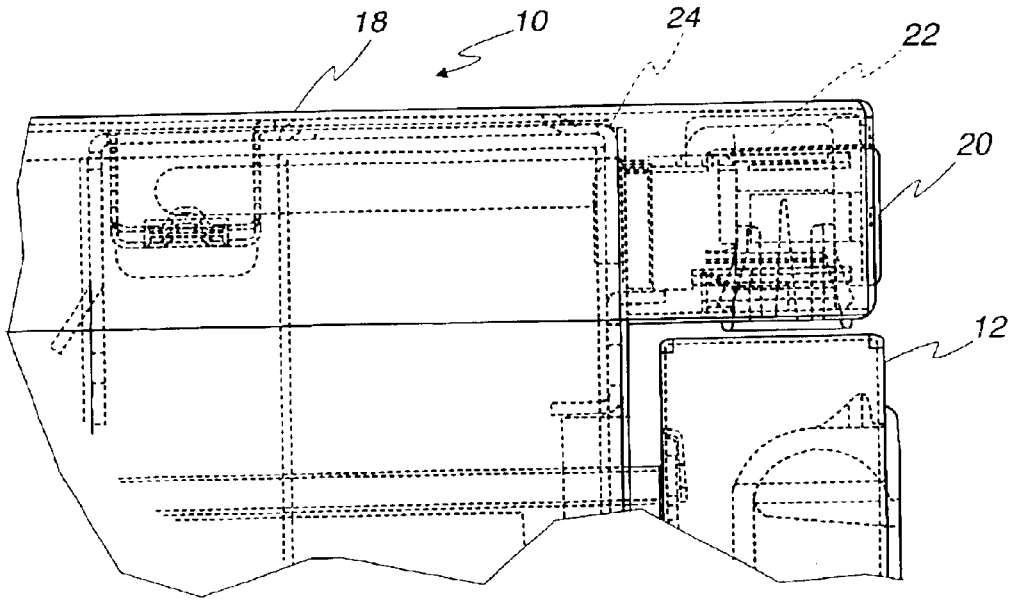
FIG. 2 is an enlarged partial side elevation view of the pedestal illustrating the lockheader, the lock housing, the lock and a reinforcing channel.
Figure 3:
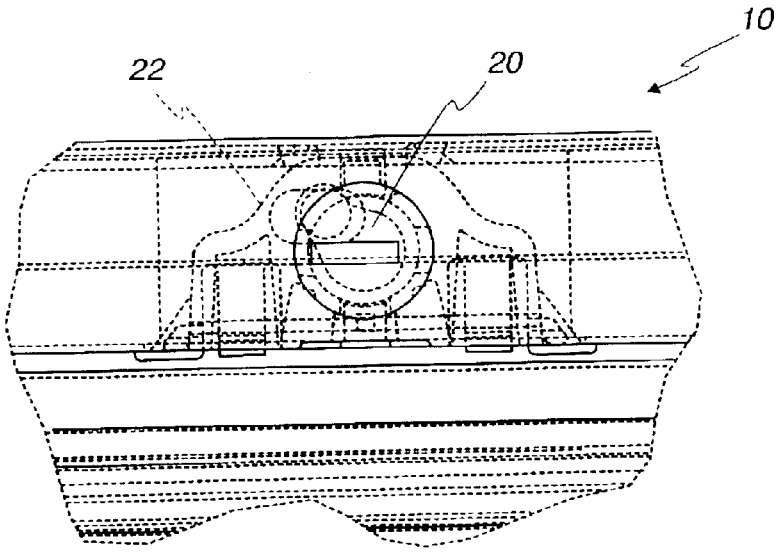
FIG. 3 is a partial front elevation view of the pedestal.
Figure 4:
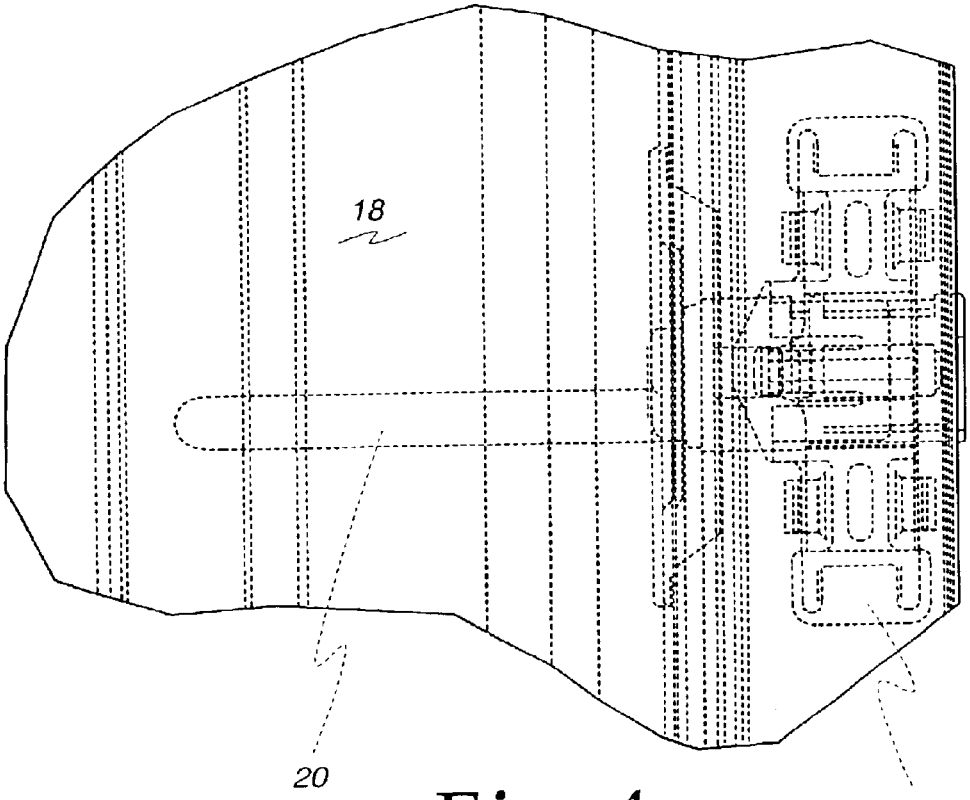
FIG. 4 is a partial top plan view of the pedestal.

Referring now to FIGS. 2, 3 and 4, the relevant portions of the pedestal 10 are shown in more detail. The lock 20 is mounted horizontally in a lock housing 22 which in turn is mounted in the lockheader 18 above the boxdrawer 12. A header reinforcing structure 24 is connected to the lockheader.

Referring now to FIGS. 5–8, the lockheader or top wall section of the pedestal is shown in more detail. The lockheader 18 includes a main horizontal panel 30 which forms the top wall of the pedestal, two side walls 32, 34, a front wall 36 and a short bottom wall 38. Formed in the bottom wall 38 is a generally rectangular opening 40. Formed in the front wall 36 is a round opening 42.

The channel shaped reinforcing structure 24 is shown in more detail in FIGS. 9–14. The reinforcement structure includes a top wall 50, a front wall 52 and a back wall 56. Formed in the front wall 52 is a rectangular opening 56 with a forward extending bracing flange or lip 58 formed along a bottom side of the opening 56. Located in the top wall 50 are a number of keyhole shaped openings, such as the opening 60, which may be used should the pedestal be suspended from a desk or table rather than supported on a floor 62 as shown in FIG. 1. Both the lockheader 18 and the reinforcing structure 24 maybe formed of cold rolled and oiled steel.

The lock housing 22 is shown in more detail in FIGS. 15–22. The lock housing may be molded of Acetal or Nylon to have a body portion 70 with a central opening 72. The opening includes a front end 74 and a rear end 76. A bracing projection 78 is formed adjacent the front end 74 and a motion limiting flange 80 overhands the central opening at the rear end 76. A horizontally disposed snap leg 82 is also formed at the rear end 76 of the central opening 72. By the term "snap leg", it is meant a cantilevered tab that is able to flex under load and then snap or return to an original position once the load is released. The body portion 70 also includes a pair of shoulders 84, 86 from which extend vertically directed snap legs 90, 92, 94, 96.

The shoulders also support two arms 98, 100 that each include the enforcing ribs 102, 104, 106, 108 and flange feet 110, 112.

Figure 5:
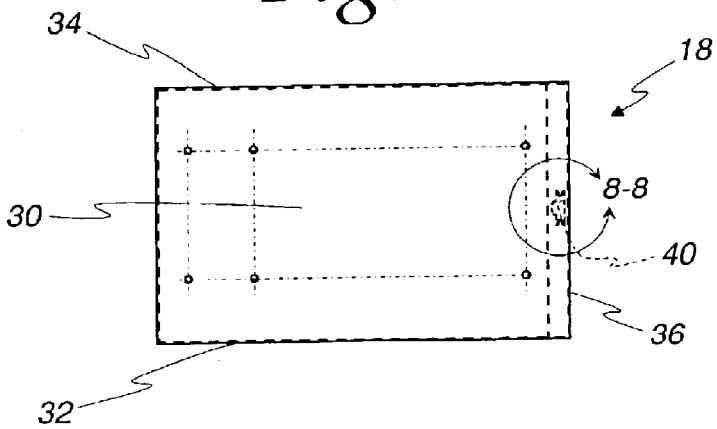
FIG. 5 is a top plan view of the lockheader.
Figure 6:
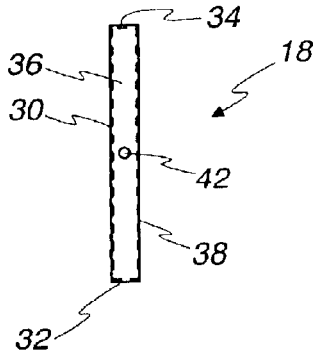
FIG. 6 is a front elevation view of the lockheader.
Figure 7:
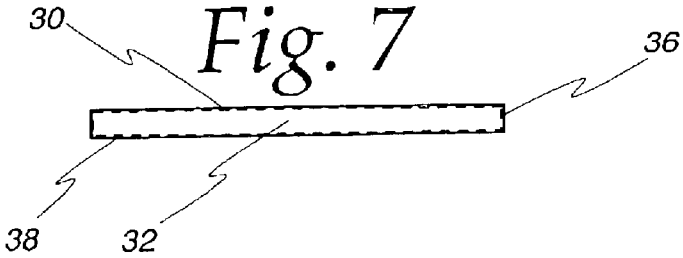
FIG. 7 is a side elevation view of the lockheader.
Figure 8:
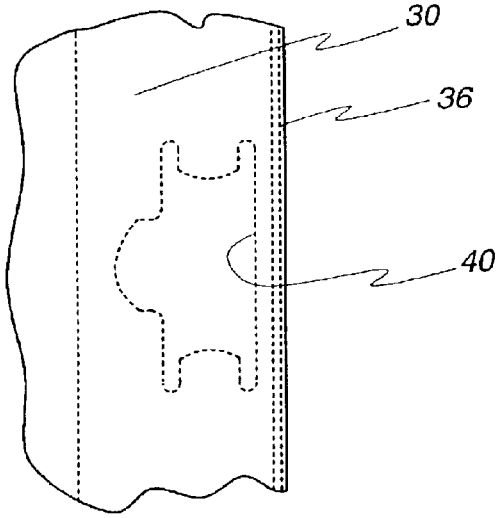
FIG. 8 is a top plan view taken within circle 8—8 of FIG. 5.
Figure 9:
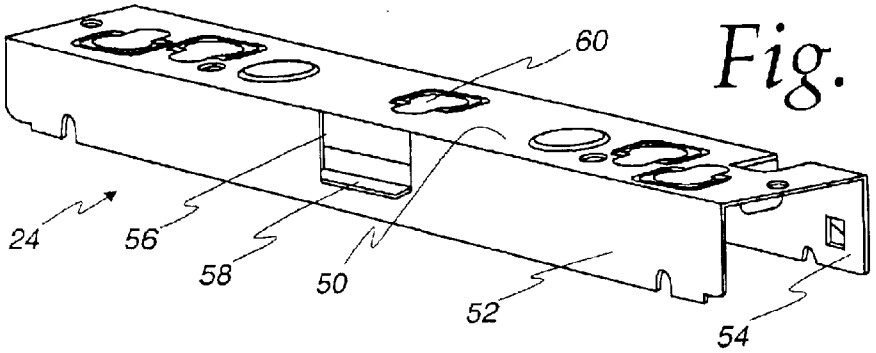
FIG. 9 is a isometric view of the reinforcing channel.
Figure 12:
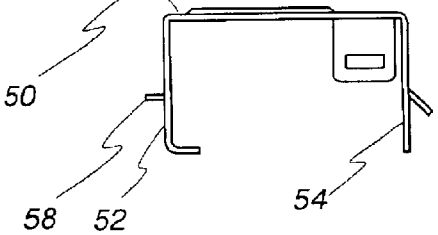
FIG. 12 is a side elevation view of the reinforcing channel.
Figure 10:
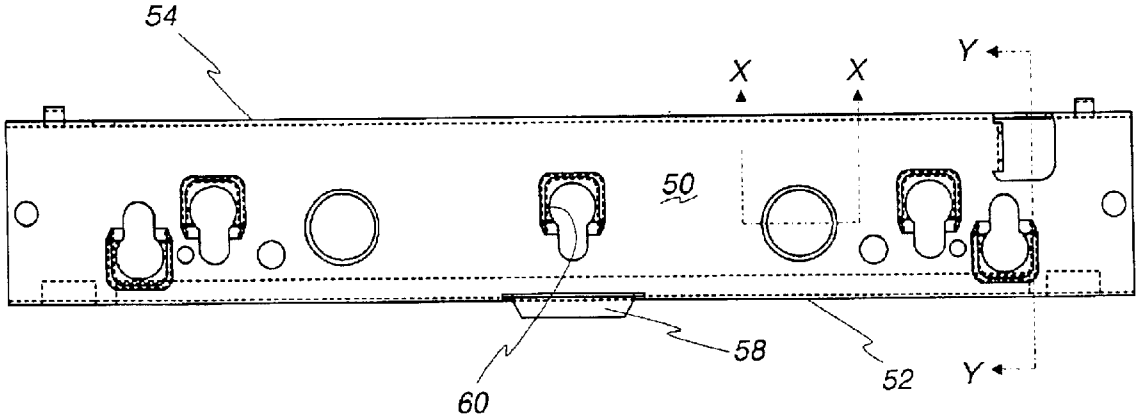
FIG. 10 is a top plan view of the reinforcing channel.
Figure 11:
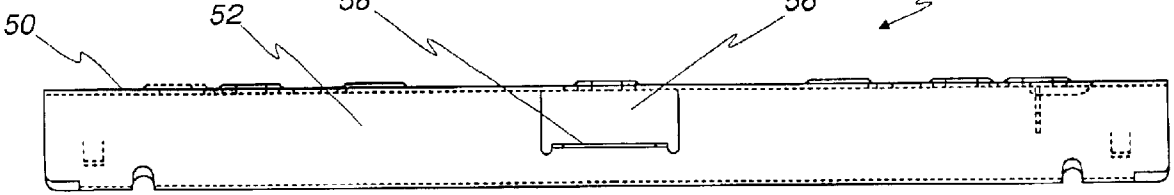
FIG. 11 is a front elevation view of the reinforcing channel.
Figure 13:
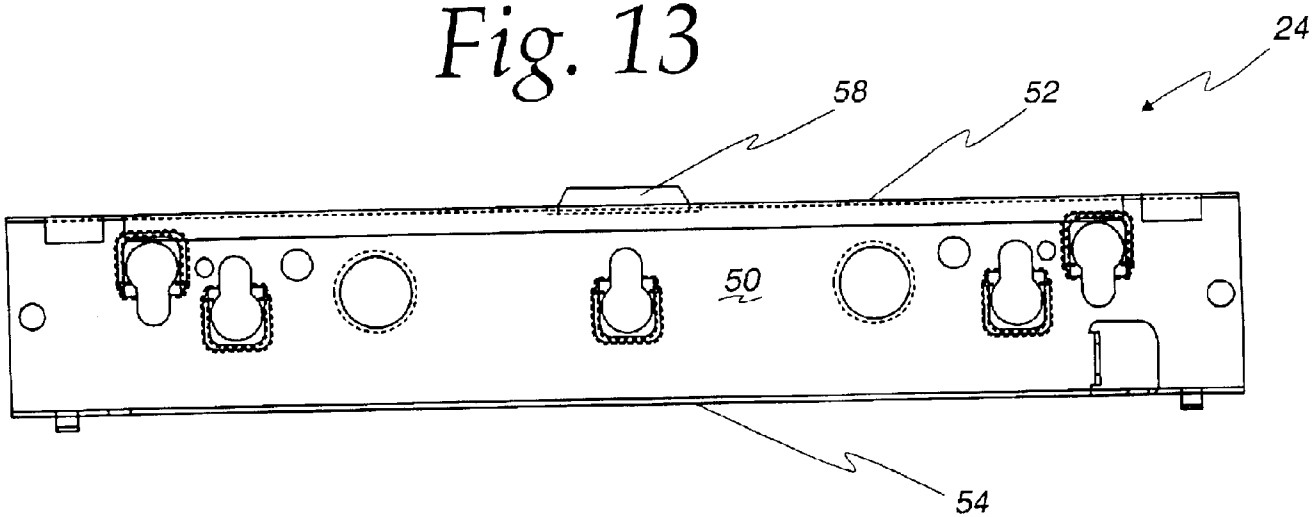
FIG. 13 is a bottom plan view of the reinforcing channel.
Figure 14:
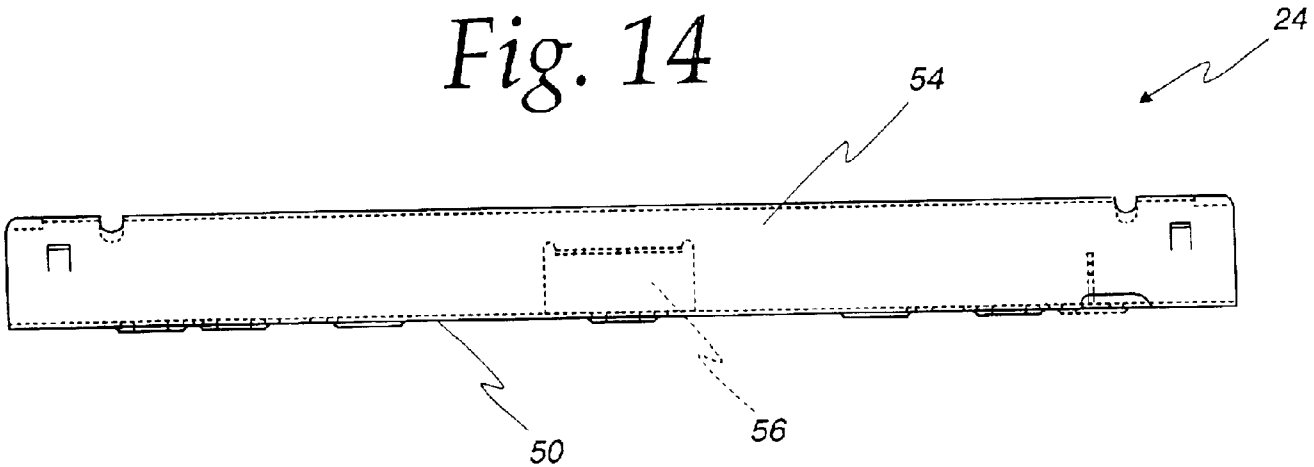
FIG. 14 is a rear elevation view of the reinforcing channel.
Figure 15:
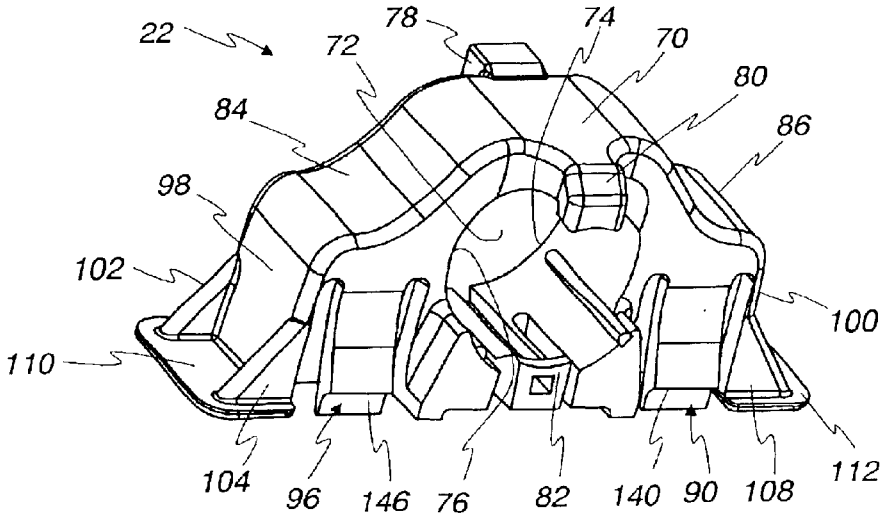
FIG. 15 is an isometric view of the lock housing.
Figure 16:
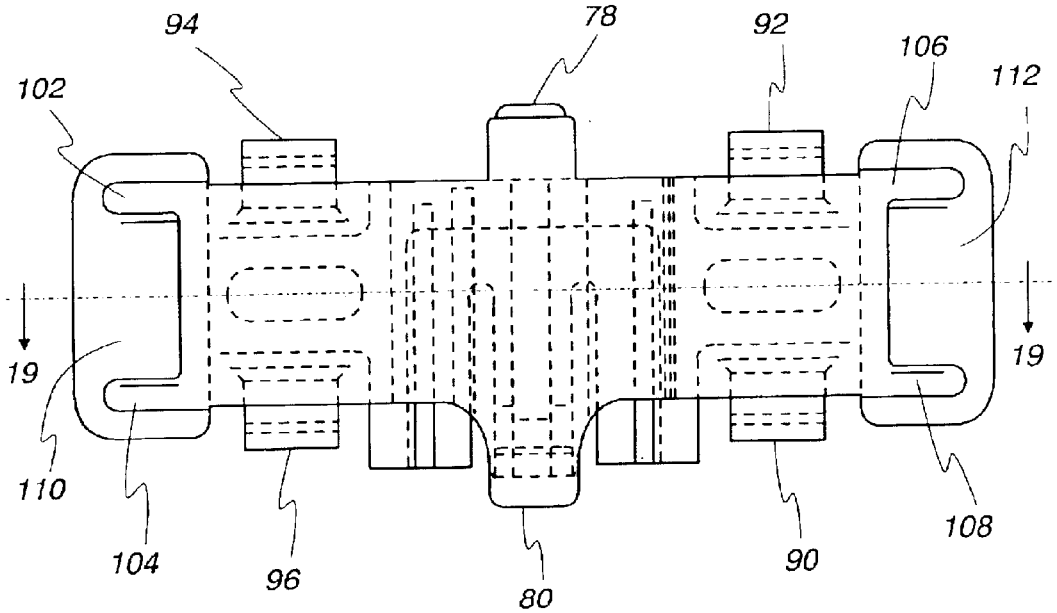
FIG. 16 is a top plan view of the lock housing.
Figure 17:
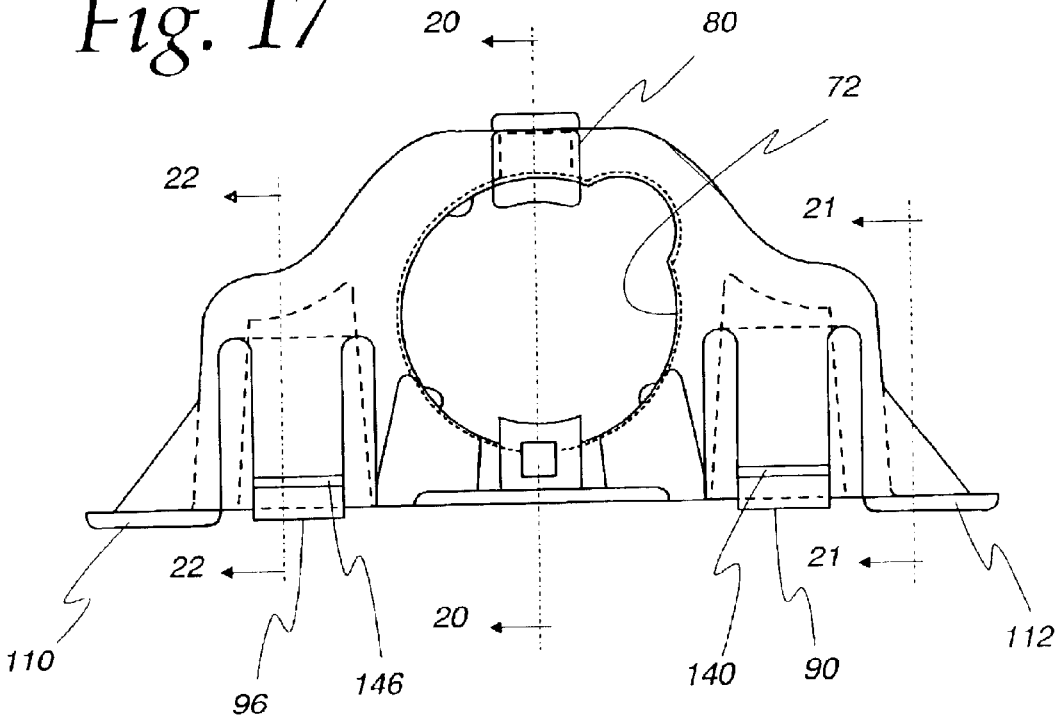
FIG. 17 is a front elevation view of the lock housing.
Figure 18:
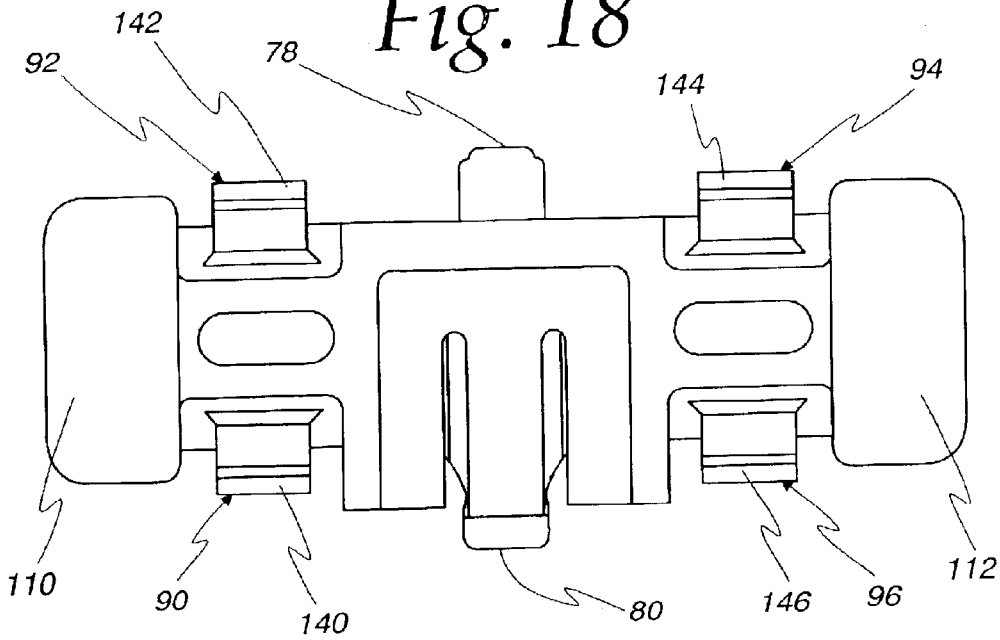
FIG. 18 is a bottom plan view of the lock housing.
Figure 19:
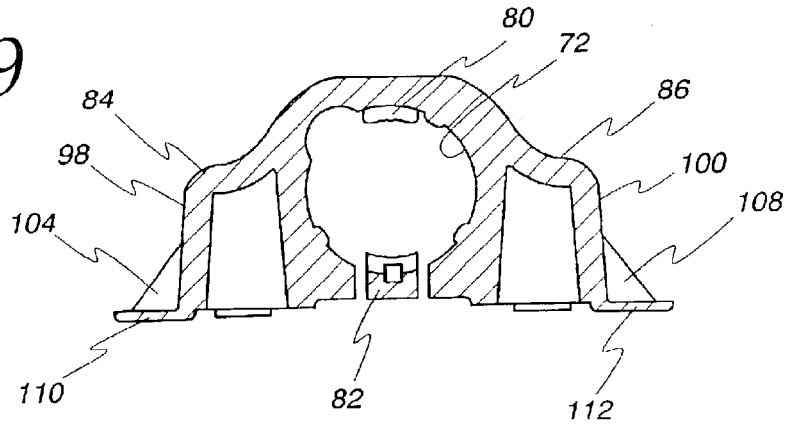
FIG. 19 is a sectional view of the lock housing taken along line 19—19 of FIG. 16.
Figure 20:
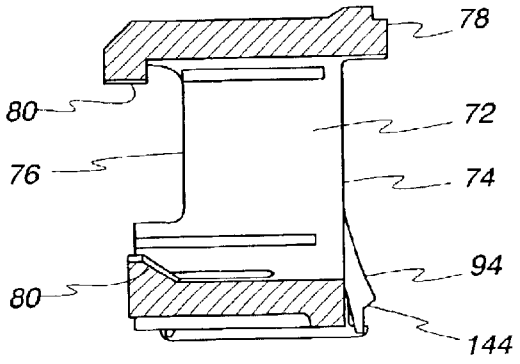
FIG. 20 is a sectional view taken along the line 20—20 of FIG. 17.
Figure 21:
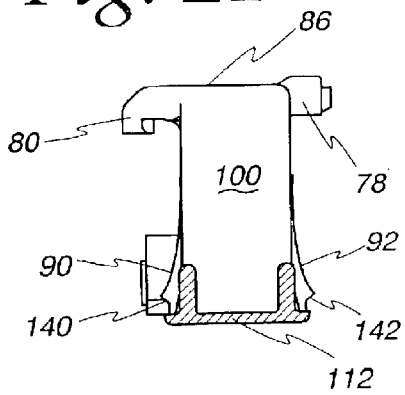
FIG. 21 is a sectional view taken along the line 21—21 of FIG. 17.
Figure 22:
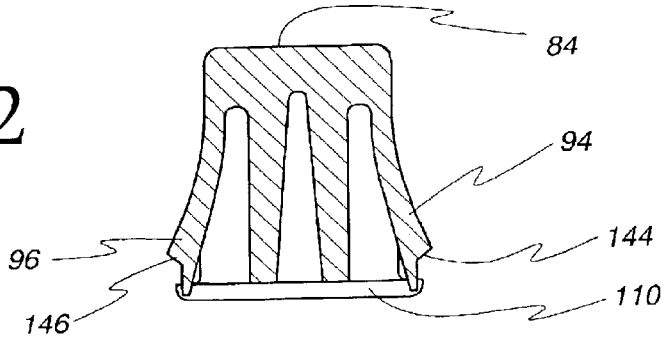
FIG. 22 is a sectional view taken along the line 22—22 of FIG. 17.

The four vertical snap legs 90, 92, 94, 96 are constructed to engage a flange which forms the border of the opening 40 in the bottom wall 38 of the lockheader 18, FIGS. 5 and 8. The horizontal snap leg 82 engages the lock 20 to create an interference fit between the lock housing and the lock.

The lock 20 is shown in more detail in FIGS. 23–28. The lock 20 includes a barrel 120 and a lock bar 122. The barrel includes a front surface 124 in which is formed a key slot 126. Located around the barrel are recesses in the form of pockets and slots, such as the pocket 128 and the slot 130. Also formed in the barrel is a circumferential groove 132. The slot 130 includes a shoulder 131 which functions to engage the motion limiting flange 80 of the lock housing to limit the axial position of the lock in the lock housing. The engagement of the slot 130 and the flange 80 also prevents rotation of the lock relative to the lock housing. The pocket 128 functions to receive and engage the snap leg 82 to restrain the lock from backing out of the central opening 72.

It may now be appreciated how simple is the structure of the front loading lock system. Nevertheless, a strong, reliable and dependable lock system is provided. In particular, the arrangement described allows the lock housing to be snap fitted into the lockheader whereby an interference fit is created between the two components to securely hold the lock housing in place. No fasteners are required. A similar approach allows the lock to be front loaded by insertion axially. The insertion is limited by the flange on the lock housing and an interference fit is created between the lock and the horizontal snap leg of the lock housing to securely mount the lock in the lock housing. Further, by the clever expedient of the bracing flange 58 of the reinforcement structure 24, the end of the barrel distant from the front face 124 is supported so that the lock barrel is mounted not only to the lock housing but is braced by the reinforcement structure. The lock housing also includes the projection 78 to brace the front wall 36 of the lockheader 18.

The lock system is easily assembled into the pedestal simply by pushing or inserting the lock housing into the bottom opening of the lockheader. Inserting the lock housing flexes the four vertical snap legs as the bottom wall around the opening 40 bears against the snap legs until shoulders 140, 142, 144, 146 clear the wall at which time the snap legs snap back to their original position. This creates an interference fit between the snap legs and the bottom wall. The lock is then inserted or pushed into the front opening in the front wall of the lockheader, then through the central opening of the lock housing and finally through the front opening in the reinforcing structure. The lock may be pushed inwardly in an axial direction until the motion limiting flange abuts the shoulder 131 formed on the barrel portion of the lock. At the same time the horizontally disposed snap leg engages in the pocket 128 to constrain the lock in position and prevent rotation.

The above specification describes in detail a preferred embodiment of the present invention. Other examples, embodiments, modifications and variations will, under both the literal claim language and the doctrine of equivalents, come within the scope of the invention defined by the appended claims. For example, modifying the structure of the lock housing or the shape of the bracing projection or the number of snap legs are considered equivalent structures and will also come within the literal language of the claims. Still other alternatives will also be equivalent as will many new technologies. There is no desire or intention here to limit in any way the application of the doctrine of equivalents nor to limit or restrict the scope of the invention.

What is claimed is:

1. A braced front loading lock system for office furniture comprising in combination:

a furniture cabinet;

a lockheader forming part of said cabinet, said lockheader having a first opening and a second opening;

a reinforcing structure connected to said lockheader, said reinforcing structure having an opening and a support flange;

a lock housing connected to said lockheader through said first opening, said lock housing having a body portion with a central opening, a projection, and structure for forming an interference fit with a flange surrounding said first opening of said lockheader; and a lock mounted flush in said second opening of said lockheader and mounted in said central opening of said lock housing, said lock having structure for causing an interference fit between said lock housing and said lock, and said support flange of said reinforcing structure for bracing said lock.

2. The lock system as claimed in claim 1 wherein:

said flange of said reinforcing structure extends in a direction toward said second opening of said lockheader.

3. The lock system as claimed in claim 2 wherein:

said first opening of said lockheader is a bottom opening and said second opening of said lockheader is a front opening.

4. The lock system as claimed in claim 3 wherein:

said lockheader includes a front wall having said front opening; and said projection of said lock housing is for bracing said front wall of said lockheader.

5. The lock system as claimed in claim 1 wherein:

said lock housing includes a horizontally directed snap leg for engaging said lock.

6. The lock system as claimed in claim 5 wherein:

said lock housing includes a motion limiting flange for positioning said lock.

7. The lock system as claimed in claim 1 wherein:

said lock housing includes a plurality of vertically directed snap legs for forming the interference fit with said lockheader.

8. The lock system as claimed in claim 1 wherein:

said lock housing includes reinforcing ribs and flange feet for positioning said lock housing relative to said lockheader.

9. The lock system as claimed in claim 1 wherein:

said lock housing includes a snap leg; and said lock includes a barrel portion having a recess for receiving said snap leg of said lock housing.

10. The lock system as claimed in claim 9 wherein:

said flange of said reinforcing structure extends in a direction toward said second opening of said lockheader.

11. The lock system as claimed in claim 10 wherein:

said first opening of said lockheader is a bottom opening and said second opening of said lockheader is a front opening.

12. The lock system as claimed in claim 11 wherein:

said lockheader includes a front wall having said front opening; and said projection of said lock housing for bracing said front wall of said lockheader.

13. The lock system as claimed in claim 12 wherein:

said lock housing includes a plurality of vertically directed snap legs for forming the interference fit with said lockheader.

14. The lock system as claimed in claim 9 wherein:

said lock housing includes a plurality of vertically directed snap legs for forming the interference fit with said lockheader.

15. The lock system as claimed in claim 14 wherein:

said lock housing includes a motion limiting flange for positioning said lock.

16. A front loading lock system for office furniture comprising in combination:

a furniture cabinet;

a lockheader connected to said cabinet, said lockheader having a bottom opening and a front opening;

a reinforcing channel-shaped structure connected to said lockheader, said reinforcing structure having a front opening and a forward projecting flange;

a lock housing snap fitted to said lockheader through said bottom opening, said lock housing having a body portion with a central opening for alignment with said front opening of said reinforcing structure and said front opening of said lockheader, the body portion opening having front and rear ends, a projection mounted adjacent to said front end of said central opening for bracing said lockheader, a horizontally directed snap leg formed at the rear end of said central opening, a motion limiting flange formed adjacent said rear end of said central opening, a plurality of vertically directed snap legs connected to said body portion, two arms with reinforcing ribs and flange feet connected to said body portion, said plurality of vertically directed snap legs for forming an interference fit with a flange surrounding said bottom opening of said lockheader; and a lock mounted flush in said front opening of said lockheader, in said front opening in said reinforcing structure and in said central opening of said lock housing, said lock having a lock bar and a barrel portion with two recesses, a first recess for receiving said horizontally directed snap legs and for causing an interference fit therewith and a second recess for engaging said motion limiting flange of said lock housing, said forward projecting flange of said reinforcing structure for supporting said barrel.

17. A method for assembling a front loading lock system for office furniture comprising the steps of:

providing a furniture cabinet;

providing a lockheader as part of said cabinet, said lockheader having a bottom opening and a front wall and a front opening in said front wall;

providing a reinforcing structure connected to said lockheader, said reinforcing structure having a front opening and a forward projecting flange;

providing a lock housing having a central opening, a projection, and a plurality of snap legs;

providing a lock;

inserting said lock housing in said bottom opening to cause an interference fit between said plurality of snap legs of said lock housing and said lockheader; and inserting said lock into said front opening of said lockheader, said central opening of said lock housing and said front opening of said reinforcing structure to cause an interference fit between said lock and said lock housing, said projecting positioned to brace said front wall of said lockheader and said forward projecting flange of said reinforcing structure for bracing said lock.

* * * * *